US007755339B2

(12) United States Patent
Kojima et al.

(10) Patent No.: US 7,755,339 B2
(45) Date of Patent: Jul. 13, 2010

(54) REGULATOR WITH ERROR AMPLIFIER HAVING LOW VOLTAGE AND HIGH VOLTAGE TRANSISTORS

(75) Inventors: Tomokazu Kojima, Osaka (JP); Takahito Kushima, Osaka (JP)

(73) Assignee: Panasonic Corporation, Osaka (JP)

( * ) Notice: Subject to any disclaimer, the term of this patent is extended or adjusted under 35 U.S.C. 154(b) by 377 days.

(21) Appl. No.: 11/806,716

(22) Filed: Jun. 4, 2007

(65) Prior Publication Data

US 2008/0007242 A1 Jan. 10, 2008

(30) Foreign Application Priority Data

Jul. 7, 2006 (JP) ..... 2006-187884

(51) Int. Cl.
*G05F 1/56* (2006.01)

(52) U.S. Cl. ..... 323/280; 330/252

(58) Field of Classification Search ..... 323/280; 330/252, 253, 255, 260, 261
See application file for complete search history.

(56) References Cited

U.S. PATENT DOCUMENTS

| | | | | |
|---|---|---|---|---|
| 6,137,356 | A | 10/2000 | Sakuragi | |
| 6,531,855 | B2 | 3/2003 | Miki et al. | |
| 6,965,266 | B1 * | 11/2005 | Can | 330/252 |
| 2005/0253654 | A1 * | 11/2005 | Kwon et al. | 330/260 |

* cited by examiner

*Primary Examiner*—Harry Behm
(74) *Attorney, Agent, or Firm*—McDermott Will & Emery LLP

(57) ABSTRACT

A regulator for generating, from a first power supply voltage exceeding the breakdown voltage of a low voltage transistor block, a second power supply voltage lower than or equal to the breakdown voltage of the low voltage transistor block, includes an operational amplifier including low voltage transistors and high voltage transistors. An operational amplifier including only low voltage transistors can be employed.

5 Claims, 10 Drawing Sheets

REGULATOR WITH ERROR AMPLIFIER HAVING LOW VOLTAGE AND HIGH VOLTAGE TRANSISTORS

BACKGROUND OF THE INVENTION

1. Field of the Invention

The present invention relates to a power supply circuit for use in a liquid crystal display apparatus or the like. More particularly, the present invention relates to a high drive performance power supply circuit including a liquid crystal driver, a controller, a memory and the like.

2. Description of the Related Art

According to a conventional technique, there is a series regulator type direct current power supply circuit in which a drive state of a series transistor is controlled, depending on a change in output voltage, so as to suppress overshoot and undershoot during rising of power supply without an increase in capacitance value of an output smoothing capacitor (see U.S. Pat. No. 6,531,855).

According to another conventional technique, there is an operational amplifier in which a phase compensating capacitor and a variable resistance element are connected in series to control the resistance value of the variable resistance element, depending on the magnitude of an input difference voltage, so as to simultaneously achieve a highly stable operation and a high-speed operation (see U.S. Pat. No. 6,137,356).

Of mobile apparatuses, such as, representatively, mobile telephones and the like, apparatuses which have a plurality of functions and include a power supply circuit are becoming more widespread. In such apparatuses, a plurality of power supply voltages required for the functions are generated in the apparatus so that the number of external power supplies to the apparatus is reduced, and power supply is controlled ON/OFF, depending on ON/OFF of the functions, whereby low power consumption can be expected.

In semiconductor integrated circuits, when a power supply voltage is supplied from a power supply circuit to a low voltage transistor block, a regulator is conveniently comprised of an operational amplifier.

When power is externally supplied to a semiconductor integrated circuit, the power supply voltage varies by about 10% to 20%. In this case, in the vicinity of the lower limit of the power supply voltage, the speed is likely to decrease due to the decrease of the power supply voltage. Also, in the vicinity of the upper limit of the power supply voltage, the transistor is likely to be destroyed due to the increase of the power supply voltage. To avoid this, an operational amplifier is used to supply a high-precision power supply voltage. Thereby, a voltage which does not exceed the breakdown voltage of low voltage transistors is supplied, and further, a voltage which does not cause a reduction in speed is supplied, whereby a low voltage transistor block (e.g., a memory) can be comprised of low voltage transistors, resulting in a small area. In addition, the low voltage transistors can have a thin gate oxide film, thereby making it possible to reduce the parasitic capacitance and thereby increasing the speed.

However, the operational amplifier included in the regulator needs to withstand a voltage higher than or equal to the breakdown voltage of the transistors in the low voltage transistor block. For example, in a liquid crystal display apparatus, it is assumed that the breakdown voltages of the controller and the memory are 2 V, the breakdown voltage of the source drivers is 6 V, and the breakdown voltage of the gate drivers is 20 V, where the source drivers and the gate drivers are provided as liquid crystal drivers. In this case, power supply circuits for the respective parts are each comprised of transistors having a breakdown voltage which is higher by 1 to 2 V or by one grade than the breakdown voltage of the corresponding part. In the latter case, the power supply circuits for the controller and the memory are each comprised of 6-V transistors, and the power supply circuit for the source drivers is comprised of 20-V transistors.

Thus, the power supply circuit for use in liquid crystal display apparatuses has significant drawbacks in terms of circuit size and power consumption.

Firstly, when each power supply circuit is comprised of transistors having a breakdown voltage which is higher by 1 to 2 V than that of the corresponding functional circuit, a total of five or six types of transistors having different breakdown voltages are required. In addition to this, capacitors having a breakdown voltage higher by one grade, and in some cases, inductors and resistors, are required. As the number of transistors having different breakdown voltages is increased, the semiconductor process cost increases.

Next, when transistors having breakdown voltages higher by one grade than the respective breakdown voltages are used, the area is increased, resulting in an increase in cost of the semiconductor integrated circuit. In this case, when the 2-V transistor and the 6-V transistor are compared, the gate oxide film thicknesses and the areas of the diffusion portions of the source and the drain are increased by a factor of about 2 to 4. Further, the minimum transistor gate lengths are different by a factor of 2 to 4. Thereby, the area is increased by a factor of 4 to 16. Further, the increase of the gate oxide film thickness leads to an increase in variation of the threshold voltage VT of the transistor, and also, a reduction in speed due to a reduction in drive performance and an increase in parasitic capacitance. Therefore, the characteristics are poor, and the foreseeability of the design is low.

Another problem relates to power consumption. When the controller and the memory consume 10 mA, the power consumption is supposed to be the product with the breakdown voltage of 2 V, i.e., 2 V×10 mA=20 mW. However, when a power supply circuit for supplying 10 mA has a breakdown voltage of 6 V, the power consumption is 6 V×10 mA=60 mW, which is 3 times as high as the required power consumption.

SUMMARY OF THE INVENTION

Therefore, an object of the present invention is to provide, in a semiconductor integrated circuit which has a plurality of functions, a power supply circuit which minimizes increases in current consumption and chip area and causes each functional block to stably operate.

To achieve this object, the present invention provides a power supply circuit in a semiconductor integrated circuit, comprising a regulator for generating a second power supply voltage from a first power supply voltage, and supplying the second power supply voltage to a low voltage transistor block. The regulator comprises an operational amplifier comprising low voltage transistors having a breakdown voltage lower than the second power supply voltage and high voltage transistors having a breakdown voltage higher than the second power supply voltage. Alternatively, the regulator comprises an operational amplifier in which all transistors are low voltage transistors each having a breakdown voltage lower than the second power supply voltage.

According to the power supply circuit of the present invention, although the power supply circuit is a circuit which includes high voltage transistors or a circuit which handles a voltage exceeding the breakdown voltage of low voltage transistors, it is possible to achieve a stable, low-power-consumption power supply circuit having characteristics comparable to those of a low voltage transistor circuit. In addition, a major circuit can be configured using low voltage transistors, so that the area of a system including the power supply circuit can be reduced.

DETAILED DESCRIPTION OF THE PREFERRED EMBODIMENTS

Embodiment 1

Hereinafter, Embodiment 1 of the present invention will be described with reference to the accompanying drawings.

Figure 1:
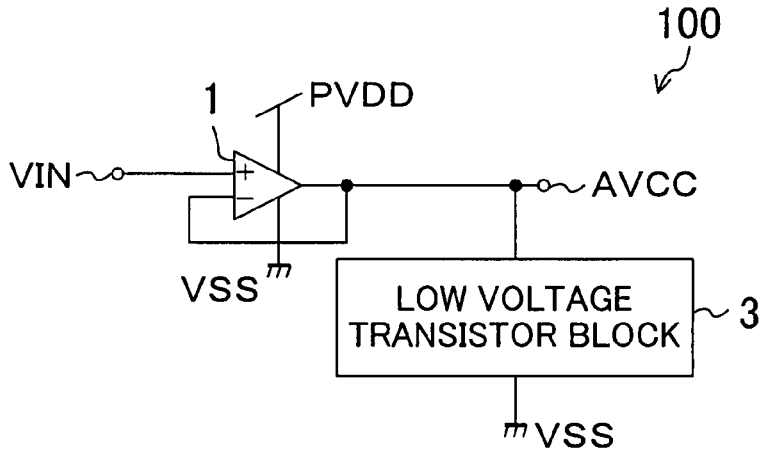
FIG. 1 is a diagram showing a configuration of a power supply circuit according to Embodiment 1 of the present invention.

FIG. 1 is a diagram showing an exemplary configuration of a power supply circuit 100 according to the present invention which has a small area, is stable, and has low power consumption. In FIG. 1, VIN indicates a reference voltage for supplying power, 1 indicates an operational amplifier for buffering the reference voltage VIN, PVDD indicates a power supply for the operational amplifier 1, and VSS indicates the ground. AVCC indicates an output of the operational amplifier 1, and a power supply for a low voltage transistor block 3. The low voltage transistor block 3 is a functional block on the same chip which is operated with the power supply AVCC.

The operational amplifier 1 comprises high voltage transistors which have a higher breakdown voltage than that of the transistors of the low voltage transistor block 3, and low voltage transistors which have a breakdown voltage which is equal to or lower than that of the transistors of the low voltage transistor block 3. The operational amplifier 1 has a voltage follower structure as shown in FIG. 1, in which the reference voltage VIN is connected to the non-inverting input terminal of the operational amplifier 1.

Figure 6:
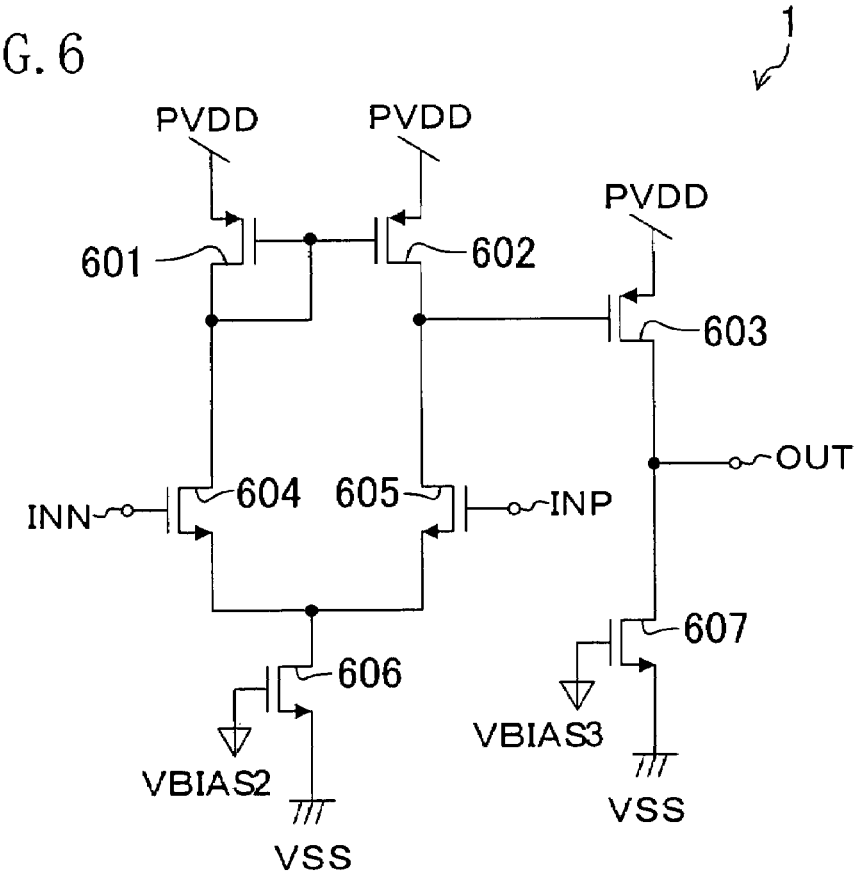
FIG. 6 is a diagram showing a second configuration of the operational amplifier for achieving the power supply circuit of Embodiment 1 of the present invention.

The operational amplifier 1 basically has a two-stage amplifier structure as shown in FIG. 6. In this case, in the operational amplifier 1, only transistors 604 and 605 constituting a differential amplification circuit are low voltage transistors, and the other transistors are high voltage transistors. Conventionally, the low voltage transistor block 3 is comprised of low voltage transistors, while the other transistors are high voltage transistors. In contrast to this, in the circuit of FIG. 1, the differential amplification circuit of the operational amplifier 1 is comprised of low voltage transistors (604 and 605).

The power supply AVCC may be additionally provided with a capacitor which is of the order of several microfarads (μF) so as to smooth a variation in output voltage of the operational amplifier 1 when the current amount of the low voltage transistor block 3 is 10 mA or more or when an operation is performed with a high operating speed of several tens or more of MHz.

An operation of the power supply circuit 100 will be described in more detail with reference to FIGS. 1 and 6. It is here assumed that the power supply AVCC for the low voltage transistor block 3 is 2 V and the power supply voltage PVDD for the power supply circuit 100 which generates the power supply AVCC is 5 V. In this case, 2 V is input as the reference voltage VIN.

FIG. 6 is a circuit diagram showing the operational amplifier 1. High voltage transistors 601 and 602 constitute an active load circuit. High voltage transistors 606 and 607 constitute a current mirror circuit. A high voltage transistor 603 constitutes an output stage. The low voltage transistors 604 and 605 constitute a differential amplification circuit. INP, INN and OUT indicate a non-inverting input terminal, an inverting input terminal, and an output terminal of the operational amplifier 1, respectively.

Here, the transistors 604 and 605, which are conventionally supposed to be high voltage transistors, will be described, indicating why they can be low voltage transistors.

The voltages of the drains of the low voltage transistors 604 and 605 are lower by the gate-source voltages VGS of the high voltage transistors 601 and 602, respectively, than PVDD. Here, it will be understood that, when the operational amplifier 1 is stably operated, the high voltage transistors 601 and 602 have substantially the same drain-source voltage VDS, and further, the VGS and VDS of the high voltage transistor 601 are equal to each other.

It is here assumed that the high voltage transistors 601 and 602 have a threshold voltage VT of about 2.0 V. High voltage transistors generally have a large gate oxide film thickness and a high VT so as to increase the breakdown voltage.

Further, the high voltage transistors 601 and 602 are set to have a small transistor size ratio W/L.

In this case, for the high voltage transistors 601 and 602, current equations will be considered. Since the current equations are similar to each other, the current equation of the high voltage transistor 601 will be particularly described.

A drain current IDS is represented by:

$$IDS=(1/2)\times\mu\times Cox\times(W/L)\times(VGS-VT)^2 \quad (1)$$

where μ represents a charge mobility, Cox represents a gate oxide film thickness, W/L represents a transistor size ratio, and the high voltage transistor 601 is operated within a saturated region.

In expression (1), by determining IDS and obtaining μ and Cox from process information, VGS can be calculated. Here, W/L may be selected which leads to VGS≧1.0V.

By determining W/L in this manner, the VGS of the high voltage transistor 601 can be caused to be 3 V. Also, the VDS of the high voltage transistor 606 can be caused to be more than 0.

In this case, the voltages of the transistors 604 and 605 will be described.

$VGS=INP-$(the $VDS$ of the high voltage transistor 606)<2.0 V, $VDS=$(the drain voltage of the high voltage transistor 602)−(the drain voltage of the high voltage transistor 606)=($PVDD-$the $VDS$ of the high voltage transistor 602)−(the drain voltage of the high voltage transistor 606)<2.0 V, and $VBS\leqq$(the drain voltage of the high voltage transistor 602)−0<2.0 V (2)

Note that the inequality signs in expression (2) indicate that the back gate voltages of the transistors 604 and 605 are set to be the ground voltage, the source voltage, or an intermediate voltage therebetween.

Thus, a voltage of 2.0 V or more is not applied to the terminals of the transistors 604 and 605. Therefore, a problem does not arise when the transistors 604 and 605 are each a low voltage transistor having a breakdown voltage of 2 V.

Thus, the differential amplification circuit of the operational amplifier 1 is comprised of the low voltage transistors 604 and 605, thereby obtaining advantages, such as a low offset voltage, a high-speed operation, and a small area. This is because low voltage transistors have the following features: a thin gate oxide film thickness; a small gate capacitance; a small variation in VT; and a small transistor size.

By employing the operational amplifier 1 thus configured, a high-precision power supply circuit can be achieved irrespective of the small area.

Figure 3:
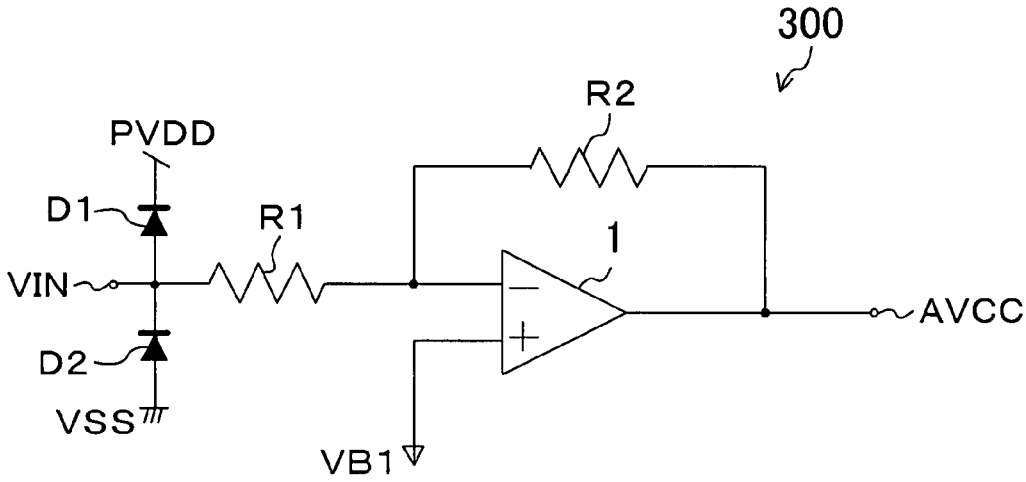
FIG. 3 is a diagram showing a first configuration of the power supply circuit of Embodiment 1 of the present invention when an output voltage of a power supply circuit is different from a reference voltage.
Figure 4:
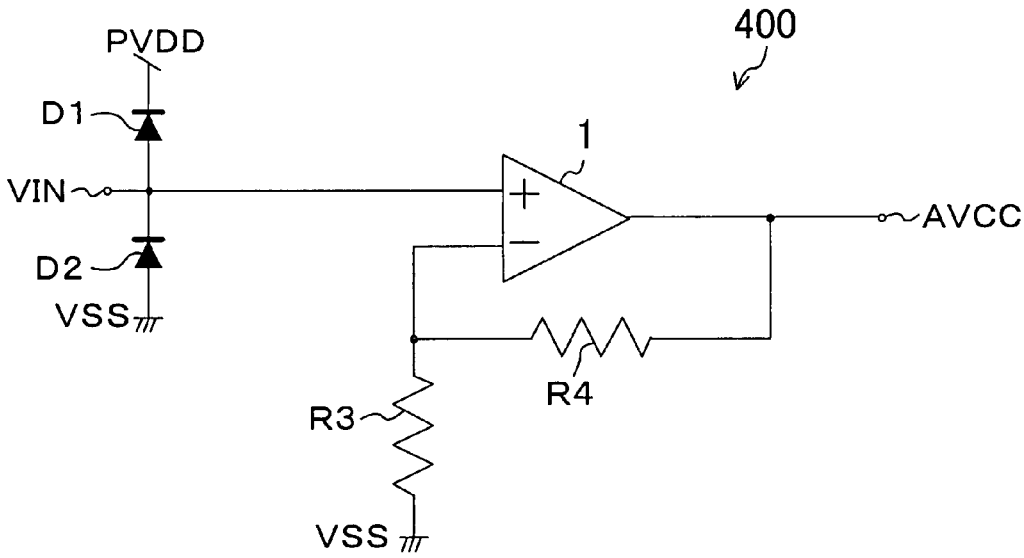
FIG. 4 is a diagram showing a second configuration of the power supply circuit of Embodiment 1 of the present invention when the output voltage of the power supply circuit is different from the reference voltage.

FIGS. 3 and 4 show power supply circuits having other configurations. When the reference voltage VIN is different from the voltage AVCC, a power supply circuit 300 of FIG. 3 generates the output AVCC by an inverting amplification operation, and a power supply circuit 400 of FIG. 4 generates the output AVCC by a non-inverting amplification operation.

Firstly, in the case of FIG. 3, D1 and D2 indicate protection diodes, R1 and R2 indicate resistors, and VB1 indicates a bias voltage. In this case, the voltage of the output AVCC of the operational amplifier 1 is represented by:

$$AVCC=(-R2/R1)(VIN-VB1).$$

It is here assumed that VB1=0 V. If it is assumed that R2/R1=2 and VIN=1.0 V, −2 V can be output. It is used when the low voltage transistor block is operated with power supplies of 0 V and −2 V.

Also in this case, the voltages of INP and INN of FIG. 6 which are the inputs of the operational amplifier 1 are both 1.0 V, so that the differential amplification circuit can be comprised of low voltage transistors.

Next, in the case of FIG. 4, R3 and R4 are resistors. In this case, the voltage of the output AVCC of the operational amplifier 1 is represented by:

$$AVCC=(1+R4/R3)VIN.$$

Here, if it is assumed that VIN=0.5 V and 1+R4/R3=4, the voltage of the output AVCC is 2.0 V.

Also in this case, the voltages of INP and INN of FIG. 6 which are the inputs of the operational amplifier 1 are both 0.5 V, so that the differential amplification circuit can be comprised of low voltage transistors.

Figure 5:
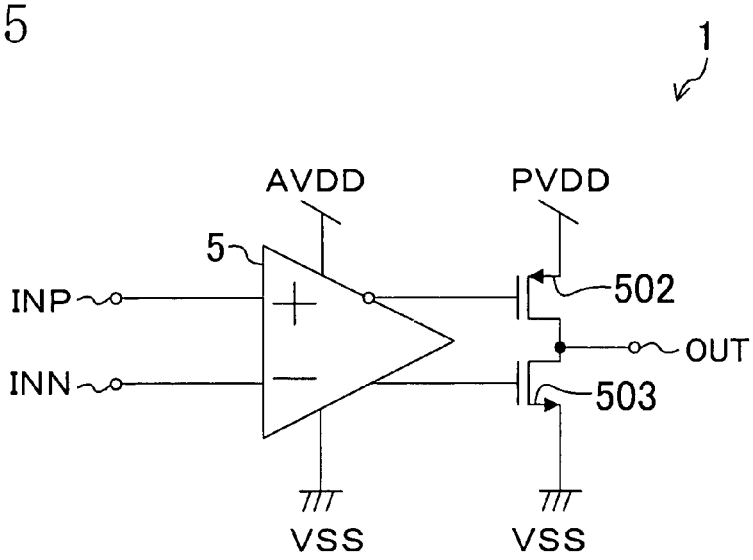
FIG. 5 is a diagram showing a first configuration of an operational amplifier for achieving the power supply circuit of Embodiment 1 of the present invention.

FIG. 5 shows the operational amplifier 1 when configured with an operational amplifier 5 having another configuration. 502 indicates a P-channel transistor and 503 indicates an N-channel transistor. In this case, a low-voltage power supply AVDD is provided for an amplification section including a differential amplification circuit and an active load circuit, and a power supply PVDD is provided for a drive circuit, thereby making it possible to achieve a differential amplification circuit having a low breakdown voltage.

Figure 7:
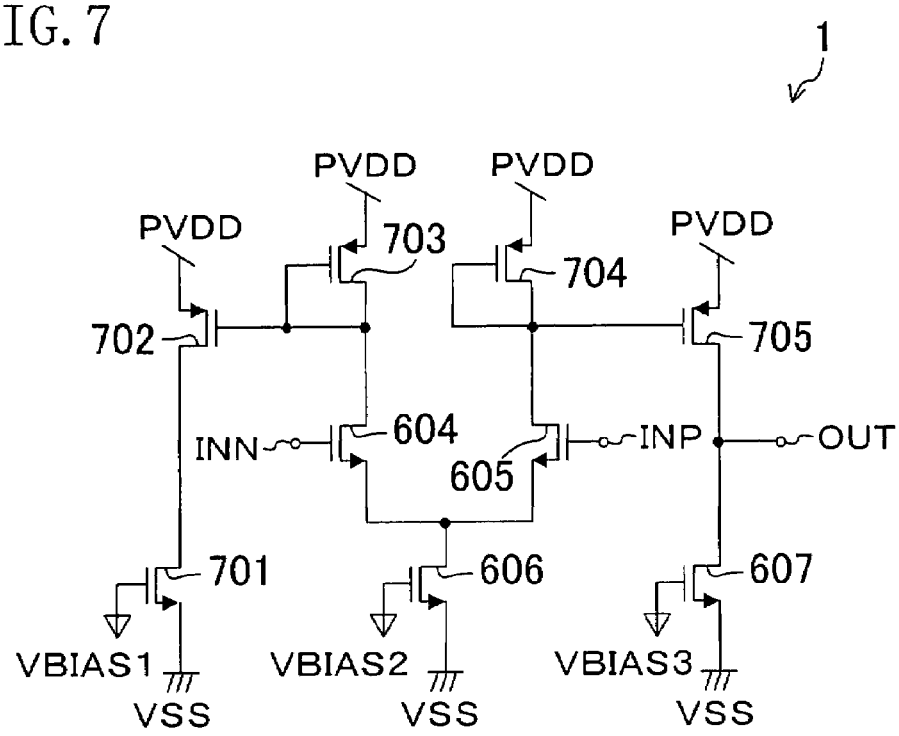
FIG. 7 is a diagram showing a third configuration of the operational amplifier for achieving the power supply circuit of Embodiment 1 of the present invention.

FIG. 7 shows a configuration in which an active load circuit is comprised of diode-connected, high voltage transistors 703 and 704, as compared to FIG. 6. Note that VBIAS1, VBIAS2 and VBIAS3 are each a bias voltage.

Figure 8:
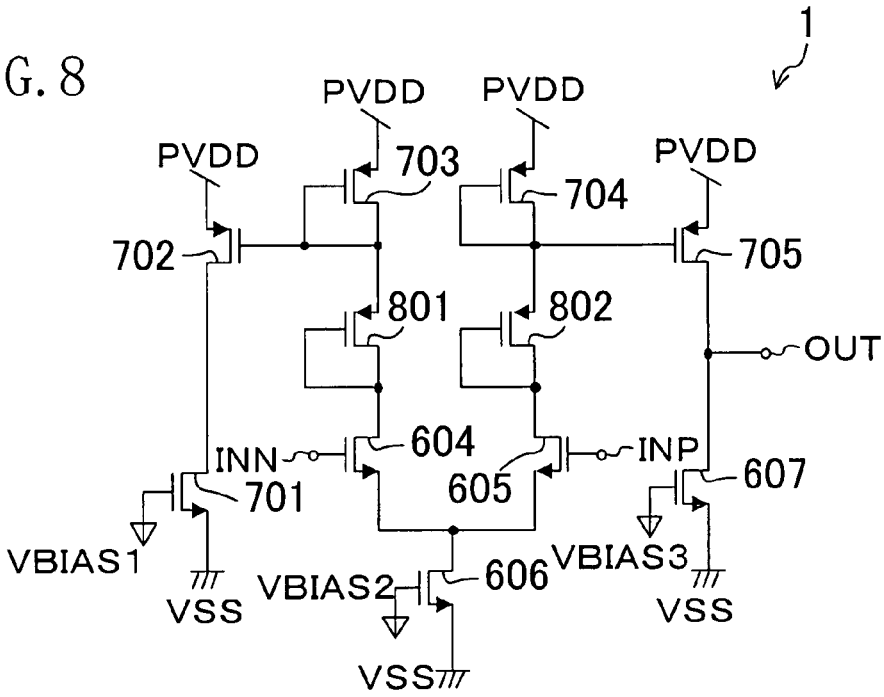
FIG. 8 is a diagram showing a fourth configuration of the operational amplifier for achieving the power supply circuit of Embodiment 1 of the present invention.

FIG. 8 shows a configuration in which an active load circuit is comprised of diode-connected transistors connected in series. In this case, transistors 703 and 704 in the active load circuit and transistors 801 and 802 connected in series thereto can be low voltage transistors. This is because only 2.0 V or less is applied to the transistors other than an output transistor 705 if the VGS of each transistor is set to be 1.5 V. In addition, if a diode-connected transistor is inserted in series to a transistor 701, the transistor 701, a transistor 702 and a transistor 607 can also be low voltage transistors. By reducing the voltages of the active load circuit and the differential amplification circuit, it is possible to further reduce a voltage shift and an offset voltage of the power supply circuit, and further, provide a higher speed and a smaller area.

Figure 9:
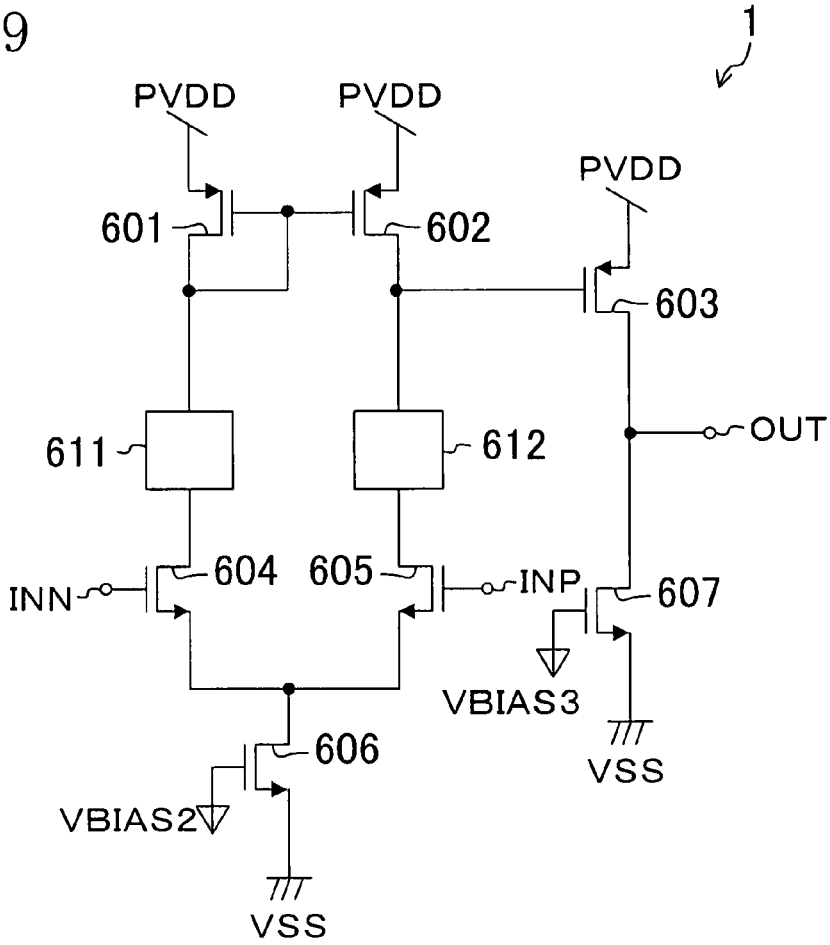
FIG. 9 is a diagram showing a fifth configuration of the operational amplifier for achieving the power supply circuit of Embodiment 1 of the present invention.

FIG. 9 shows a configuration in which clamp elements 611 and 612 are provided between an active load circuit and a differential amplification circuit. By setting a voltage difference across the clamp elements 611 and 612 to be about 2 V, transistors 601 and 602 in the active load circuit and transistors 604 and 605 in the differential amplification circuit can be low voltage transistors. Further, in this case, the clamp elements 611 and 612 are configured so as to prevent voltages from exceeding the breakdown voltage, so that the VGS of the active load circuit and the differential amplification circuit can be set without consideration of the breakdown voltage. A large transistor size and a large W/L ratio can be set. An increased dynamic range and a high-speed response can be provided.

Further, the clamp elements 611 and 612 do not contribute to operational amplification. Therefore, even when a power supply exceeds the voltage range of low voltage transistors, the low voltage transistors can be used for design in a manner similar to a power supply which does not exceed the power supply range. Therefore, not only the circuit design is foreseeable, but also it is possible to readily obtain characteristics, such as a through rate, an offset voltage or the like, which are difficult to obtain by a power supply circuit comprised of high voltage transistors. A voltage input to the differential amplification circuit is subjected to current conversion, and then to voltage conversion in the active load circuit, and is then supplied with the gate voltage of the output transistor 603, thereby obtaining the voltage of the output terminal OUT of the operational amplifier 1.

Figures 11A, 11B, 11C:
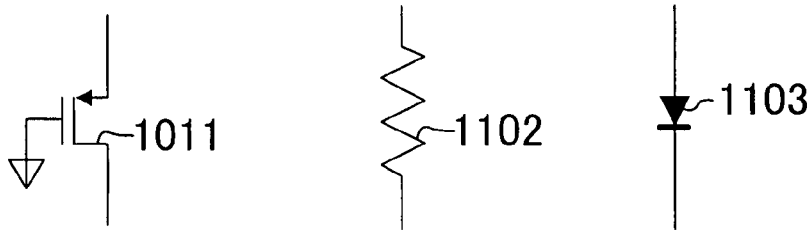
FIGS. 11A, 11B and 11C are diagrams showing configurations for achieving clamp elements according to Embodiment 1 of the present invention.

In this case, a current is transferred from the differential amplification circuit to the active load circuit. Therefore, even when a transistor 1101, a resistor 1102, and a diode 1103 as shown in FIGS. 11A to 11C are provided, the current can be transferred without a change in the current value as long as they are connected in series. With such a configuration, the transistors 601, 602, 604 and 605 can be low voltage transistors, thereby making it possible to further improve the characteristics.

Note that, when there is an even larger voltage difference between the power supply PVDD and the output AVDD, by connecting a plurality of clamp elements in series, the transistors 601, 602, 604 and 605 can also be low voltage transistors.

Figure 10:
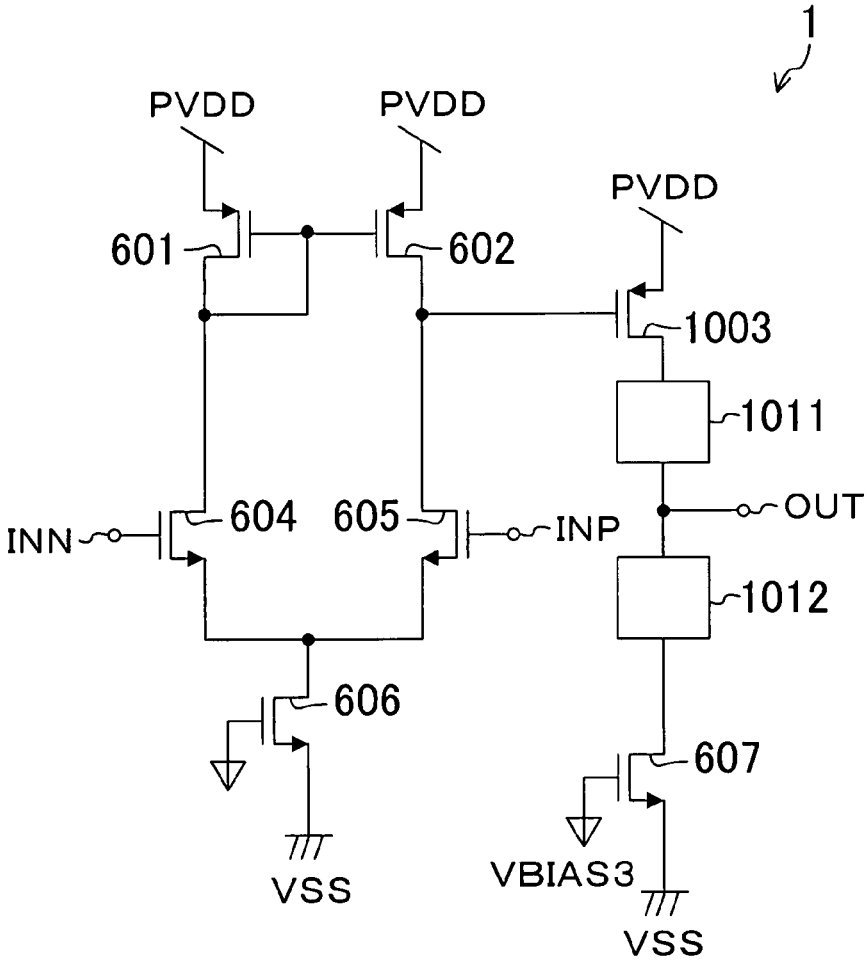
FIG. 10 is a diagram showing a sixth configuration of the operational amplifier for achieving the power supply circuit of Embodiment 1 of the present invention.

FIG. 10 shows a configuration in which a clamp element 1011 is inserted between a transistor 1003 and an output terminal OUT. In this case, the transistor 1003 can be a low voltage transistor. In addition, when there is a voltage difference between the input and the output as in FIGS. 3 and 4, by inserting a clamp element 1012 between the transistor 607 and the output terminal OUT, the transistor 607 can also be a low voltage transistor.

Figure 12:
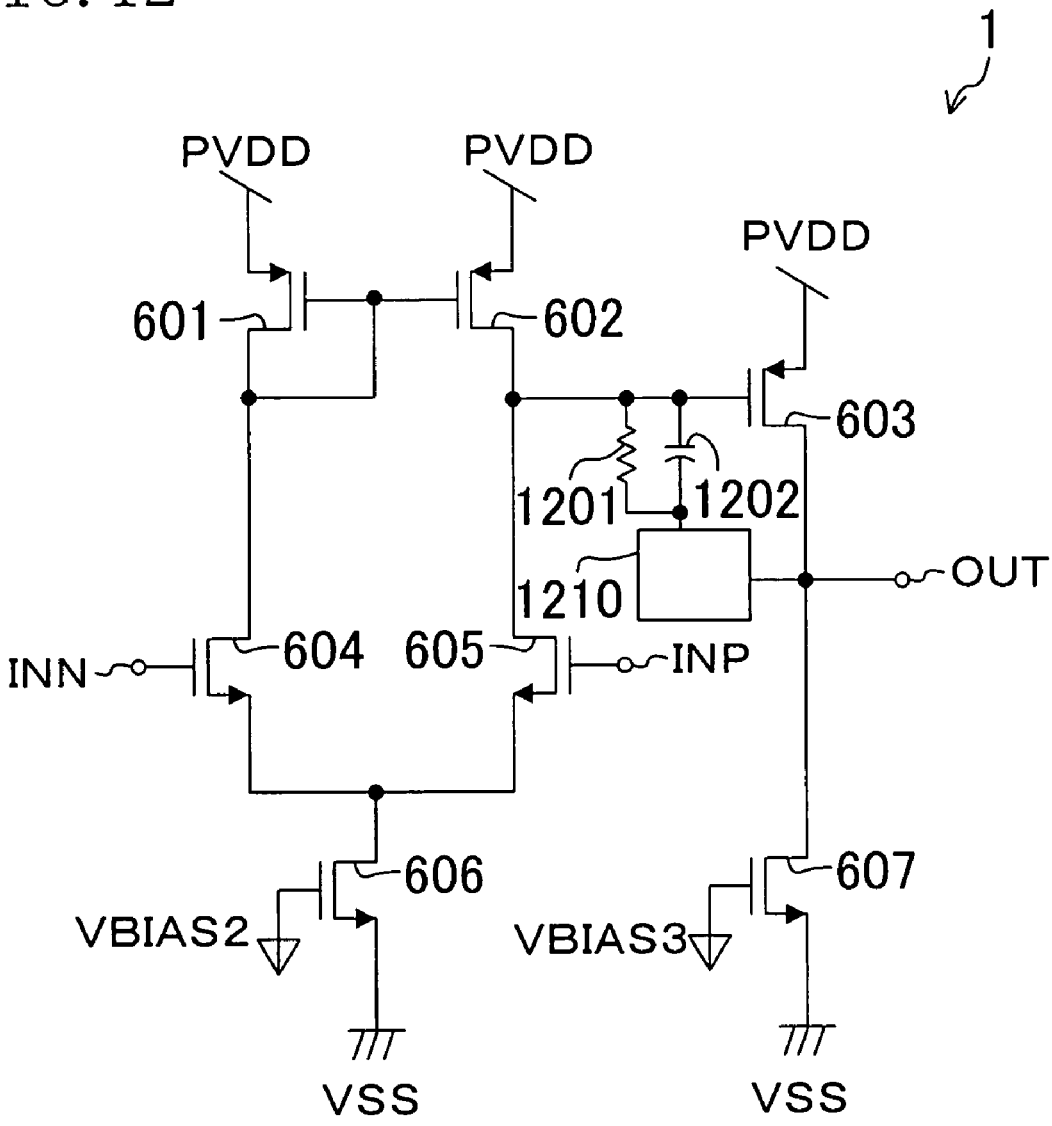
FIG. 12 is a diagram showing a seventh configuration of the operational amplifier for achieving the power supply circuit of Embodiment 1 of the present invention.

As shown in FIG. 12, when a clamp element 1210 is inserted between a resistor 1201 and a capacitor 1202, and an output terminal OUT, the resistor 1201 and the capacitor 1202 can have a low breakdown voltage. The capacitor 1202 and the resistor 1201 perform phase compensation with respect to the operational amplifier 1. In this case, a small variation in capacitance and a large capacitance are expected. In these regards, the reduction of the breakdown voltage is considerably effective. Low voltage transistors can have a thin gate oxide film thickness. Therefore, a variation in a voltage generating an inversion layer, a so-called threshold voltage, can be reduced with a decrease in the gate oxide film thickness. Also, the capacitance value can be increased with a decrease in the gate oxide film thickness. With such a configuration, a power supply circuit whose phase is stable and which does not oscillate can be achieved with a small area.

Embodiment 2

Embodiment 2 of the present invention will be described with reference to the drawings.

It has been described in Embodiment 1 that the active load circuit, the differential amplification circuit and the current mirror circuit (excluding the output transistor) constituting the operational amplifier 1 are configured using low voltage transistors, thereby improving various characteristics of the operational amplifier 1 and reducing the area thereof.

Figure 2:
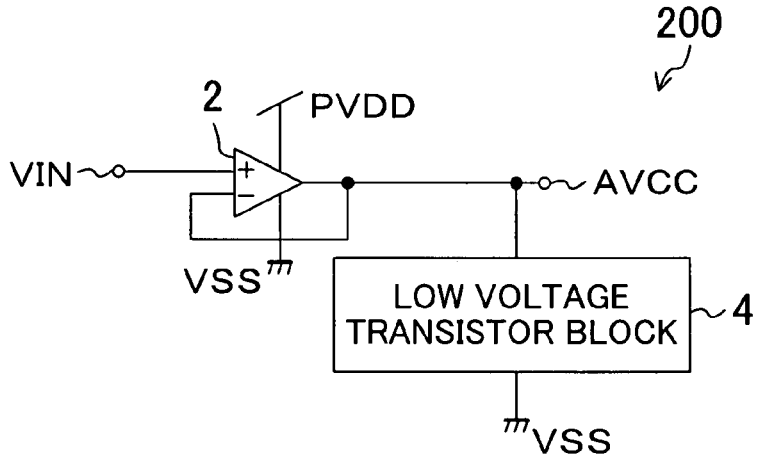
FIG. 2 is a diagram showing a configuration of a power supply circuit according to Embodiment 2 of the present invention.

In Embodiment 2 of FIG. 2, all transistors constituting an operational amplifier 2 are caused to be low voltage transistors, thereby achieving higher precision. In FIG. 2, all transistors constituting the operational amplifier 2 are low voltage transistors. 4 indicates a low voltage transistor block. In a power supply circuit 200 of FIG. 2, the same parts as those described in FIG. 1 are indicated with the same symbols and will not be described in detail.

It will be further described with reference to FIG. 13 that the operational amplifier 2 of FIG. 2 can be comprised of low voltage transistors.

Figure 13:
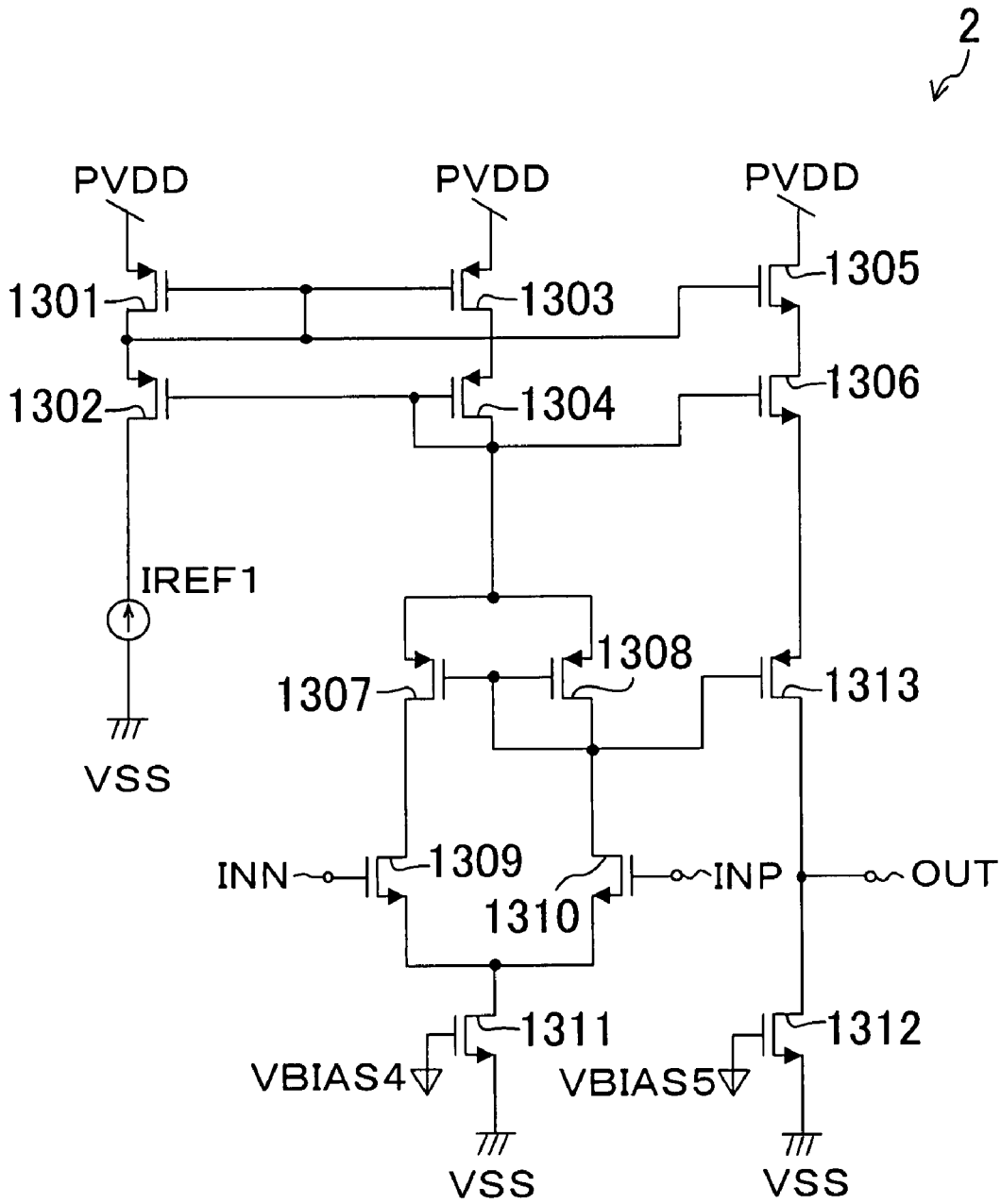
FIG. 13 is a diagram showing a first configuration of an operational amplifier for achieving the power supply circuit of Embodiment 2 of the present invention.

FIG. 13 is a diagram showing a configuration of the operational amplifier 2. Transistors 1301 to 1304 constitute a cascode current mirror circuit. The gate voltages of N-channel transistors 1305 and 1306 are equal to the gate voltage of the cascode current mirror circuit. Transistors 1309 and 1310 constitute a differential amplification circuit. Transistors 1307 and 1308 constitute an active load circuit. A transistor 1313 constitutes a drive circuit. Transistors 1311 and 1312 constitute a current mirror circuit. IREF1 indicates a bias current. VBIAS4 and VBIAS5 indicate bias voltages. The transistors 1311 and 1312 may be resistors.

It is here assumed that PVDD=5.0 V and AVCC=2.0 V. The performance of the operational amplifier 2 can be determined based on the current amounts of the cascode current mirror circuit (the transistors 1301 to 1304) and the N-channel transistors 1305 and 1306, and the transistor sizes of the transistors 1307 and 1308 of the differential amplification circuit, the transistor 1313 of the drive circuit, and the transistors 1311 and 1312 of the current mirror circuit.

In this case, attention is paid to the source voltage of the transistors 1307 and 1308 of the active load circuit, and the source voltage of the transistor 1313 of the drive circuit. If these voltages are 2 V or less, the breakdown voltage only needs to be 2 V or less, so that all transistors of the operational amplifier 2 can be low voltage transistors.

A voltage relationship between the cascode current mirror circuit (the transistors 1301 to 1304) and the N-channel transistors 1305 and 1306 will be described. The drain voltage of the transistor 1301 is equal to the gate-source voltage VGS, which is equal to about 1.5 V. Here, the threshold voltage VT and the VDSsat of the transistor 1301 are assumed to be 0.9 V and 0.6 V, respectively. Similarly, the VGS and VDS of the transistor 1304 can be assumed to be 1.5 V. Therefore, when this circuit is operated within a saturated region, the drain voltages of the transistors 1301 and 1303 and the source voltage of the transistor 1305 are equal to 3.5 V (=PVDD−1.5 V). Similarly, the drain voltages of the transistors 1302 and 1304 and the source voltage of the transistor 1306 are equal to 2.0 V (=3.5 V−1.5 V).

Thus, a voltage of 2.0 V or more is not applied to the transistors constituting the operational amplifier 2 of FIG. 13. Therefore, all the transistors constituting the operational amplifier 2 can be low voltage transistors.

Further, the current amount of the output transistor 1313 is equal to the current amount of the transistors 1305 and 1306. Also, if the transistors 1305 and 1306 are operated within a saturated region, the source voltage of the transistor 1313 does not exceed 2.0 V. Therefore, the current amount can be supplied up to a maximum current amount IMAX (=(PVDD−2.0 V)/(the ON-resistance of the transistor 1305+the ON−resistance of the transistor 1306).

As described above, with the configuration as shown in FIG. 13, the operational amplifier 2 is comprised of low voltage transistors, so that the thin gate oxide film thickness leads to a decrease in parasitic capacitance, resulting in a high-speed operation and a reduction in offset voltage. Further, the use of low voltage transistors can provide the small-area operational amplifier 2.

Figure 14:
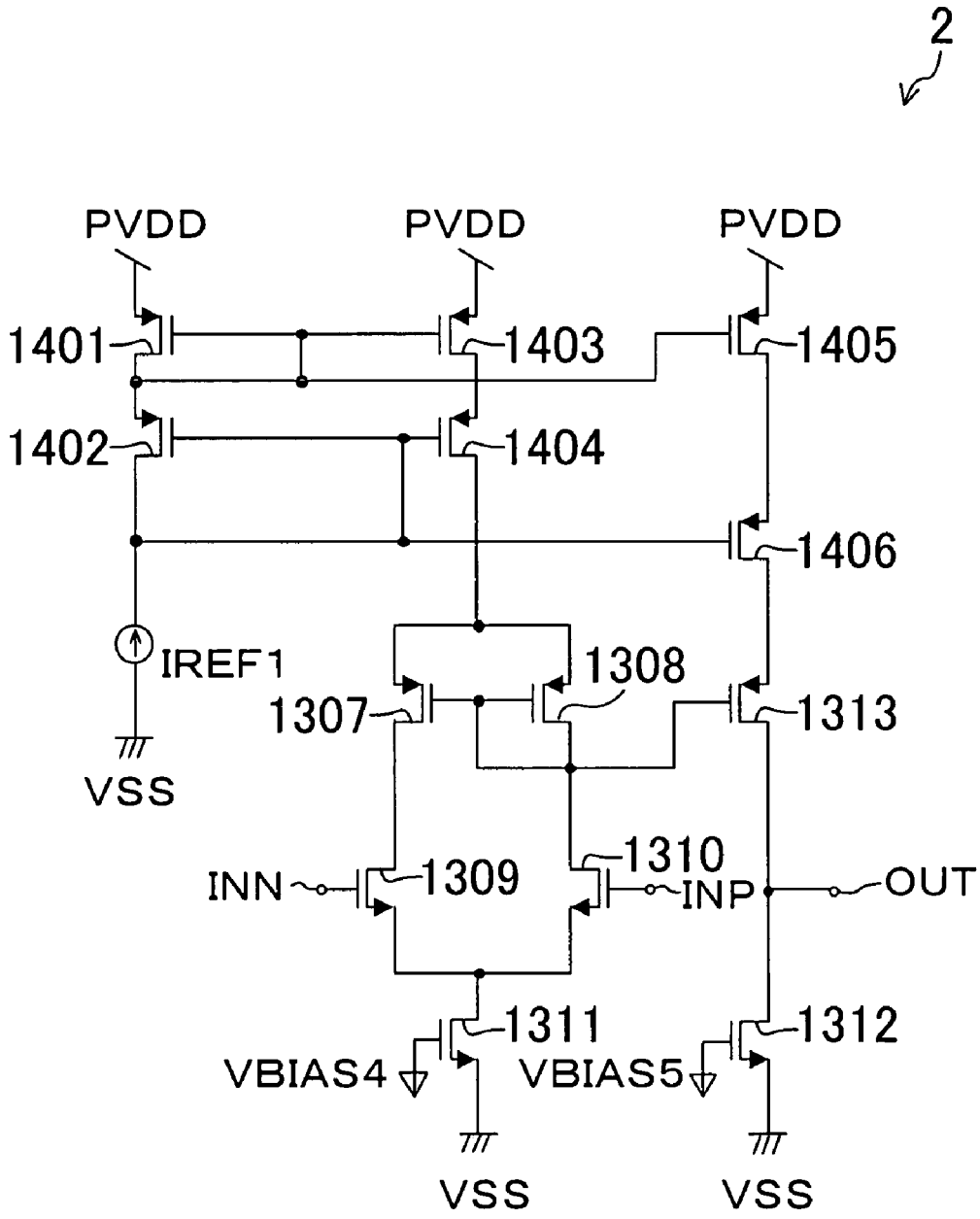
FIG. 14 is a diagram showing a second configuration of the operational amplifier for achieving the power supply circuit of Embodiment 2 of the present invention.

FIG. 14 shows a cascode current mirror circuit comprising transistors 1401 to 1406. Also, in this case, the source voltages of transistors 1307, 1308 and 1313 are 2 V or less. Therefore, all transistors can be low voltage transistors.

Although the two-stage cascode current mirror circuit is employed in FIGS. 13 and 14, the number of stages may be 3, 4, . . . , or N, depending on the difference between the power supply PVDD and the voltage AVCC of the output terminal OUT.

Figure 15:
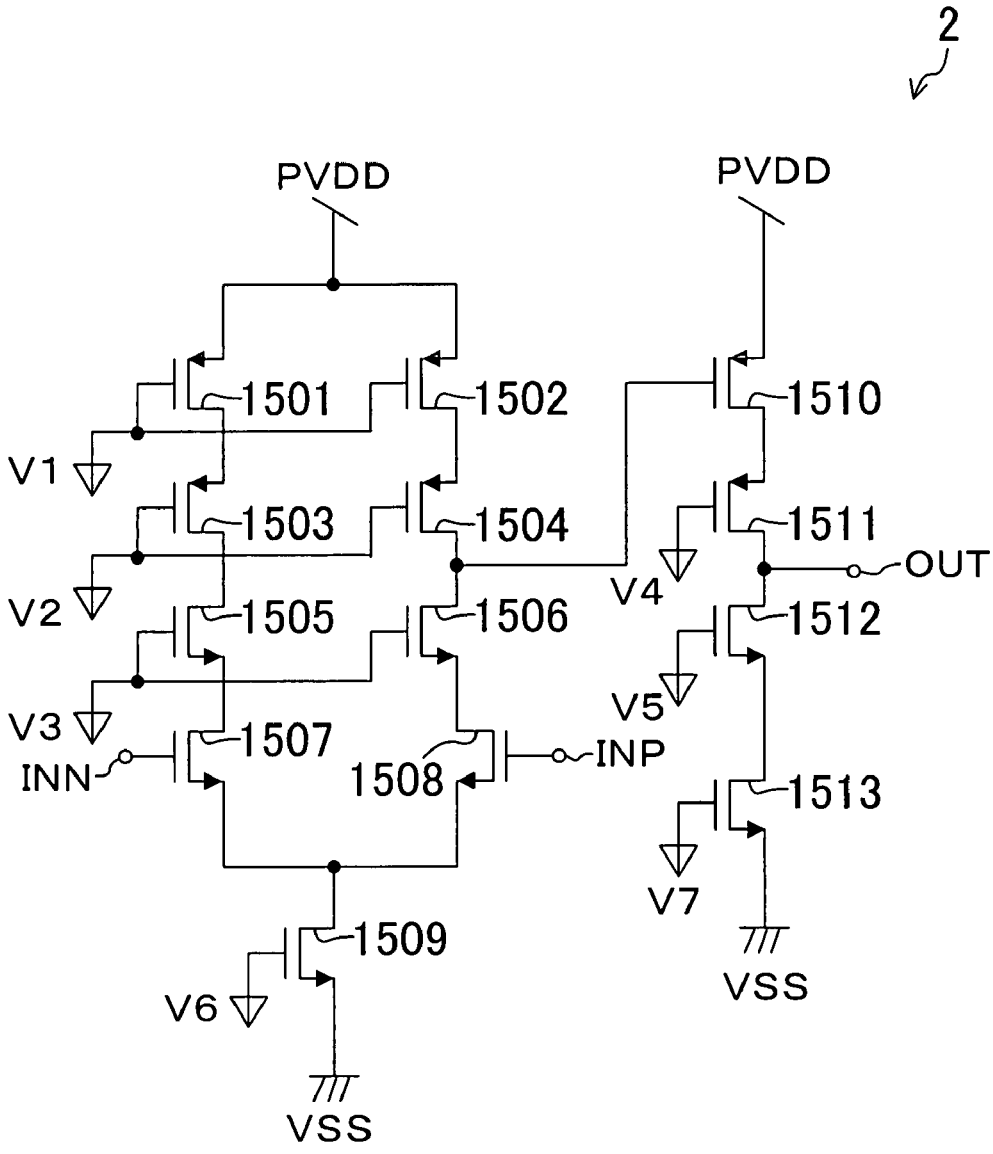
FIG. 15 is a diagram showing a third configuration of the operational amplifier for achieving the power supply circuit of Embodiment 2 of the present invention.

FIG. 15 shows a configuration in which an active load circuit, a differential amplification circuit, a current mirror circuit, and an output circuit each have a cascode structure.

In general, in the case of cascode transistors and cascode operational amplifiers, the number of stages needs to be uniform so as to increase the output impedance and thereby increase the high-frequency gain. In the output stage, if a transistor 1510 is cascoded with a transistor 1511, a transistor 1513 also needs to be cascoded with a transistor 1512. This is because the output impedance of the cascoded transistors is gm×RDS×RDS where RDS represents the output impedance of each transistor; PVDD is also handled as the ground in the case of alternative current; and the transistors 1510 and 1511 and the transistors 1512 and 1513 are apparently parallel to each other, so that a high impedance is ineffective if only one side has a cascode structure.

However, in the case of FIG. 15, the cascode structure is introduced so as to cause all transistors to be operated within a saturated region which does not exceed 2 V. Therefore, the cascode structure may be determined, depending on the voltage range.

In FIG. 15, transistors 1501 to 1504 constitute a cascode active load, transistors 1505 to 1508 constitute a cascode differential amplification circuit, the transistors 1510 and 1511 constitute a cascode output circuit, the transistors 1512 and 1513 constitute a cascode current mirror circuit, and a transistor 1509 constitutes a bias circuit. Note that the transistor 1509 may be cascoded.

In this case, if bias voltages V1 to V7 are provided so as to cause the transistors to be operated within the saturated region, all the transistors can be low voltage transistors. Further, in the case of the cascode operational amplifier of FIG. 15, the high-frequency characteristics are considerably excellent.

Figure 16:
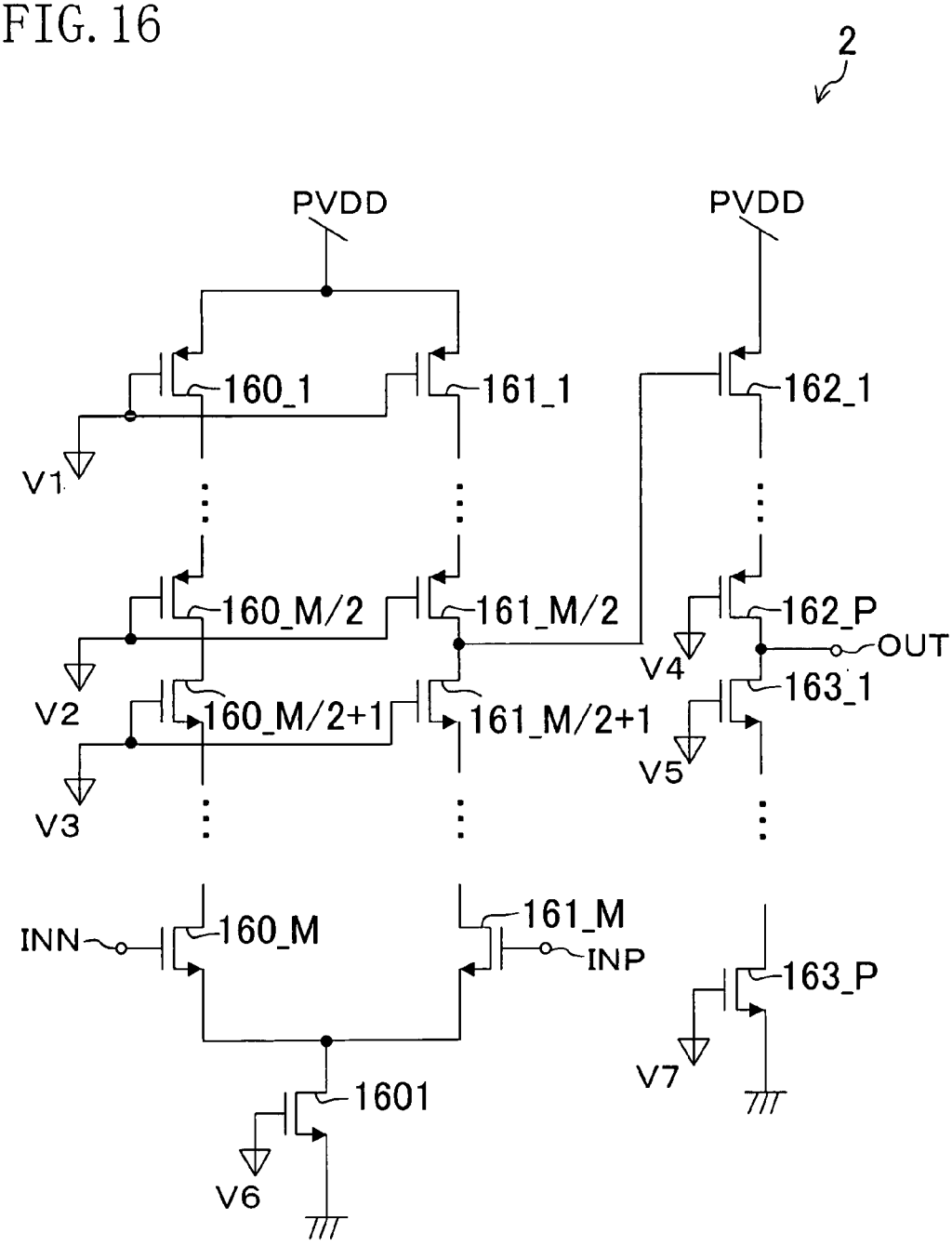
FIG. 16 is a diagram showing a fourth configuration of the operational amplifier for achieving the power supply circuit of Embodiment 2 of the present invention.

FIG. 16 shows a configuration in which, when there is further a voltage difference between the power supply PVDD and the output AVDD, the active load circuit, the differential amplification circuit, the output circuit, and the current mirror circuit are configured by cascoding (M/2−1) series transistors, whereby all transistors constituting the operational amplifier 2 can be low voltage transistors.

Also, in FIG. 16, the active load circuit and the differential amplification circuit have the same cascode structure (i.e., the same number of transistors connected in series), which can increase the output impedance. When sufficient frequency characteristics are obtained, these circuits may have different numbers of cascoded transistors.

In FIG. 16, transistors 160_1 to 160_M/2 and transistors 161_1 to 161_M/2 constitute an active load, transistors 160_M/2+1 to 160_M and transistors 161_M/2+1 to 161_M constitute a differential amplification circuit, a transistor 1601 constitutes a bias circuit, transistors 162_1 to 162_P constitute an output circuit, and transistors 163_1 to 163_P constitute an output bias circuit.

A method for determining the numbers M and P of cascode stages in this case will be described. Assuming that the transistors have substantially the same VGS, M=ΔV/VGS where ΔV represents the voltage difference between PVDD and AVCC and M represents a natural number. When the operational amplifier 2 is used to configure a full-feedback buffer as shown in FIG. 2, the same voltage is applied, so that M=P.

The high-frequency characteristics are determined from the output impedance. An output impedance Z of the differential amplification circuit and the active load circuit in this circuit is hereinafter represented by:

$$Z = \begin{pmatrix}\text{the output impedance of the}\\ \text{differential amplification circuit}\end{pmatrix} // \begin{pmatrix}\text{the output impedance of}\\ \text{the active load circuit}\end{pmatrix}$$

$$= (gm \text{ of the transistor } 161_M \times gm \times RDS \text{ of the transistor } 161_M-1 \vdots \times gm \times RDS \text{ of the transistor } 161_M/2+1 \times RDS \text{ of the transistor } 161_M/2+1) // (gm \text{ of the transistor } 161_M/2 \times gm \times RDS \text{ of the transistor } 161_M/2-1 \vdots \times gm \times RDS \text{ of the transistor } 161_2 \times RDS \text{ of the transistor } 161_1)$$

where "//" represents parallel impedance.

Note that the output impedance Z contributes to improvements in the gain and frequency characteristics of the operational amplifier, however, since the output impedance Z is also responsible for the occurrence of oscillation, oscillation is likely to occur when the output impedance Z is higher than necessary.

According to the present invention, only the use of low voltage transistors sufficiently improves the characteristics. Therefore, it is often that a large number of stages in cascode are not required, though it depends on the specification of the operational amplifier. Conversely, even in the case of M=(the breakdown voltage of a transistor)/(the number of transistors in series), since there is no problem with the breakdown voltage, the number M of cascode stages may be selected, depending on the specification of the operational amplifier, from:

$$(PVDD-AVCC)/(\text{the breakdown voltage of a transistor}) \leqq M \leqq \Delta V/VGS.$$

Further, regarding a reduction in the area which is sought by the present invention, the area can be reduced with a decrease in M.

Further, an inverting amplifier and a non-inverting amplifier which are configured using the operational amplifier 2 as shown in FIGS. 3 and 4 will be described. In this case, an input terminal INP or INN and an output terminal OUT have different voltages. Therefore, the numbers M and P of stages in cascode may be determined based on:

$$(PVDD-\text{the source voltage of the transistor } 161_M)/(\text{the breakdown voltage of the transistor}) \leqq M \leqq (PVDD-INP)/VGS, \text{ and}$$

$$(PVDD-AVCC)/(\text{the breakdown voltage of the transistor}) \leqq P \leqq (PVDD-AVCC)/VGS.$$

Also, in this case, M and P are caused to be as large as possible so as to improve the frequency characteristics of the operational amplifier 2. M may be caused to be as small as possible when importance is put on a small area and phase stability.

Although the operational amplifier 2 is configured as a two-stage amplification circuit in FIGS. 13 and 14, the operational amplifier 2 may be configured as a three-stage amplification circuit, a Rail-to-Rail operational amplifier, or the like. In this case, the resultant power supply circuit does not depart from the scope of the present invention.

Although P-channel transistors are used in the cascode current mirror circuit, a similar circuit can be configured using N-channel transistors.

Although Embodiments 1 and 2 have been heretofore described, bipolar transistors may be used instead of the MOS transistors in these embodiments to configure a power supply circuit. Further, the present invention is not limited to the above-described embodiments. Various variations and modifications can be made within the scope of the present invention as set forth in the appended claims.

According to the power supply circuit of the present invention, although the power supply circuit is a circuit which includes high voltage transistors or a circuit which handles a voltage exceeding the breakdown voltage of low voltage transistors, it is possible to achieve a stable, low-power-consumption power supply circuit having characteristics comparable to those of a low voltage transistor circuit. In addition, a major circuit can be configured using low voltage transistors, so that the area of a system including the power supply circuit can be reduced. Therefore, the present invention is useful for a high drive performance power supply circuit including liquid crystal drivers, a controller, a memory, and the like.

What is claimed is:

1. A power supply circuit in a semiconductor integrated circuit, comprising:

a regulator for generating, from a first power supply voltage, a second power supply voltage having an absolute value smaller than that of the first power supply voltage, and supplying the second power supply voltage to a low voltage transistor block operated with the second power supply voltage, wherein the regulator comprises an operational amplifier comprising low voltage transistors having a breakdown voltage lower than the second power supply voltage and high voltage transistors having a breakdown voltage higher than the second power supply voltage, and the operational amplifier comprises a phase compensating circuit, and a clamp element between the phase compensating circuit and an output of the operational amplifier.

2. The power supply circuit of claim 1, wherein the clamp element is a transistor which is biased so as to operate in a saturated region, a resistor or a diode.

3. The power supply circuit of claim 1, wherein the phase compensating circuit comprises a low voltage transistor or a low breakdown voltage element.

4. A power supply circuit in a semiconductor integrated circuit, comprising:

a regulator for generating, from a first power supply voltage, a second power supply voltage having an absolute value smaller than that of the first power supply voltage, and supplying the second power supply voltage to a low voltage transistor block operated with the second power supply voltage, wherein the regulator comprises an operational amplifier comprising low voltage transistors having a breakdown voltage lower than the second power supply voltage and high voltage transistors having a breakdown voltage higher than the second power supply voltage, the operational amplifier comprises an active load circuit and a differential amplification circuit each comprising low voltage transistors, and the operational amplifier further comprises a clamp element between the active load circuit and the differential amplification circuit.

5. The power supply circuit of claim 4, wherein the clamp element is a transistor which is biased so as to operate in a saturated region, a resistor, or a diode.

* * * * *